US009157578B2

(12) United States Patent
Hayashi

(10) Patent No.: US 9,157,578 B2
(45) Date of Patent: Oct. 13, 2015

(54) GAS SUPPLY DEVICE

(75) Inventor: Tatsuya Hayashi, Kyoto (JP)

(73) Assignee: HORIBA STEC, Co., Ltd., Kyoto-shi (JP)

( * ) Notice: Subject to any disclaimer, the term of this patent is extended or adjusted under 35 U.S.C. 154(b) by 916 days.

(21) Appl. No.: 13/254,826

(22) PCT Filed: Feb. 26, 2010

(86) PCT No.: PCT/JP2010/053038
§ 371 (c)(1),
(2), (4) Date: Sep. 2, 2011

(87) PCT Pub. No.: WO2010/101077
PCT Pub. Date: Sep. 10, 2010

(65) Prior Publication Data

US 2011/0314838 A1 Dec. 29, 2011

(30) Foreign Application Priority Data

Mar. 4, 2009 (JP) ..... 2009-051407

(51) Int. Cl.
*F17C 9/02* (2006.01)
*F17C 13/04* (2006.01)

(52) U.S. Cl.
CPC ..... *F17C 9/02* (2013.01); *F17C 2201/032* (2013.01); *F17C 2205/0323* (2013.01); *F17C 2205/0385* (2013.01); *F17C 2223/0153* (2013.01);
(Continued)

(58) Field of Classification Search
CPC ..... F17C 9/02; F17C 13/04; F17C 7/04; F17D 1/04
USPC ..... 137/861, 884; 222/3; 118/715
See application file for complete search history.

(56) References Cited

U.S. PATENT DOCUMENTS 5,279,129 A * 1/1994 Ito ..... 62/50.2
5,605,179 A * 2/1997 Strong, Jr. et al. ..... 137/884
(Continued)

FOREIGN PATENT DOCUMENTS

CN 1701422 A 11/2005
CN 1720413 A 1/2006
(Continued)

OTHER PUBLICATIONS

ISA Japanese Patent Office, International Search Report of PCT/JP2010/053038, Mar. 23, 2010, 4 pages.

*Primary Examiner* — Alissa Tompkins
*Assistant Examiner* — Nathaniel Herzfeld
(74) *Attorney, Agent, or Firm* — Alleman Hall McCoy Russell & Tuttle LLP

(57) ABSTRACT

The present invention relates to a gas supply device having a compact configuration that enables prevention of vaporized gas by requisite minimum heating means from being liquefied again and an installation area to be considerably reduced. The gas supply device is provided with: a tank configured to retain material liquid; and a mass flow controller that is connected to an inside of the tank through a first valve unit, and controls a flow rate of gas resulting from vaporizing the material liquid, in which inside an outer wall of the tank, an internal flow path is formed, and the internal flow path is provided with a generated gas lead-out line provided with: a first valve flow-in flow path connecting the inside of the tank and a first inlet port; and a first valve flow-out flow path connecting a first outlet port and an introduction port of the mass flow controller.

5 Claims, 7 Drawing Sheets

(52) U.S. Cl.
CPC . *F17C2227/0311* (2013.01); *F17C 2227/0383* (2013.01); *F17C 2227/044* (2013.01); *F17C 2250/0636* (2013.01); *F17C 2260/048* (2013.01)

(56) References Cited

U.S. PATENT DOCUMENTS

| | | | | |
|---|---|---|---|---|
| 5,630,878 | A * | 5/1997 | Miyamoto et al. | 118/715 |
| 5,769,110 | A * | 6/1998 | Ohmi et al. | 137/269 |
| 6,263,904 | B1 * | 7/2001 | Zdunek et al. | 137/375 |
| 6,648,020 | B2 * | 11/2003 | Fujimoto et al. | 137/884 |
| 7,556,059 | B2 * | 7/2009 | Takeda et al. | 137/588 |
| 2002/0096211 | A1 * | 7/2002 | Zheng et al. | 137/240 |
| 2006/0124179 | A1 | 6/2006 | Fukagawa | |
| 2006/0180078 | A1 | 8/2006 | Iizuka | |
| 2008/0085226 | A1 * | 4/2008 | Fondurulia et al. | 422/198 |
| 2008/0296791 | A1 * | 12/2008 | Okabe et al. | 261/141 |
| 2008/0305014 | A1 * | 12/2008 | Honda | 422/111 |
| 2009/0232986 | A1 * | 9/2009 | Choi et al. | 427/255.28 |
| 2009/0320754 | A1 * | 12/2009 | Oya et al. | 118/715 |

FOREIGN PATENT DOCUMENTS

| | | | |
|---|---|---|---|
| EP | 0479375 | A1 | 4/1992 |
| EP | 0572108 | A2 | 12/1993 |
| JP | 63-121898 | | 8/1988 |
| JP | 01115119 | A | 5/1989 |
| JP | 07-243591 | A | 9/1995 |
| JP | 2003-332327 | A | 11/2003 |
| JP | 2004-356595 | A | 12/2004 |
| JP | 2008190037 | A | 8/2008 |

* cited by examiner

PRIOR ART

GAS SUPPLY DEVICE

TECHNICAL FIELD

The present invention relates to a gas supply device that vaporizes material liquid to supply resultant vaporized gas at a predetermined flow rate.

BACKGROUND ART

Patent literature 1 discloses, as illustrated in FIGS. 6 and 7, such a type of gas supply device A100 in which a tank A1 retaining material liquid M is provided with a material liquid introduction pipe for introducing the material liquid M and a generated gas lead-out pipe that leads out vaporized gas, and the generated gas lead-out pipe is connected to a mass flow controller A2 to control a flow rate of the vaporized gas.

The gas supply device A100 is adapted to heat and vaporize the material liquid in the tank by a heater provided around the tank, and also heat the mass flow controller A2 by another heater to thereby prevent the vaporized gas from being liquefied again.

However, in the gas supply device A100 as disclosed in Patent literature 1, it may be understood that the generated gas lead-out pipe is brought to a constant temperature by heat transfer from the tank or the mass flow controller, and therefore is not particularly provided with heating means such as a heater, and therefore in practice, due to a change in temperature around the pipe, the gas may be liquefied. For this reason, gas generation efficiency may be reduced such that very inefficient operation is performed.

In order to address such a problem, it is thought that the pipe itself is heated to prevent the gas from being liquefied in the generated gas lead-out pipe; however, a location to install a heater is added and increases cost, which is not practical.

Also, the tank and the mass flow controller are provided separate from each other by the generated gas lead-out pipe, so that an installation area for a whole of the device is increased, and therefore, depending on layout or the like of a factory, it may be difficult to install such a gas supply device.

CITATION LIST

Patent Literature

Patent literature 1: JPA 2003-332327

SUMMARY OF THE INVENTION

Technical Problem

The present invention is made in consideration of the above-described problems, and has an object to provide a gas supply device having a compact configuration that enables vaporized gas to be prevented by requisite minimum heating means from being liquefied again and an installation area to be considerably reduced.

Solution to Problem

That is, a gas supply device of the present invention is provided with: a tank configured to retain material liquid and heat the material liquid; and a mass flow controller configured to be connected to an inside of the tank through a first valve unit and controls a flow rate of gas resulting from vaporizing the material liquid, wherein: the first valve unit is configured to have a first valve body that is directly attached onto an outer wall surface of the tank and formed with a first inlet port and a first outlet port on one surface, and a first valve that is provided inside the first valve body, and connected to the first inlet port and the first outlet port; and inside an outer wall of the tank, an internal flow path is formed, and the internal flow path is provided with a generated gas lead-out line that is provided with a first valve flow-in flow path that makes a connection between the inside of the tank and the first inlet port, and a first valve flow-out flow path that makes a connection between the first outlet port and an introduction port of the mass flow controller.

If so, it is conventionally thought that a valve for completely stopping the gas vaporized from the tank flowing into the mass flow controller has to be provided in piping between the tank and the mass flow controller, and therefore the idea that the piping such as a pipe between the tank and the mass flow controller is eliminated is not present, whereas, as in the present invention, only by providing the internal flow path inside the outer wall of the tank, and also directly attaching the first valve unit onto the outer wall surface, the piping such as a pipe can be eliminated. For this reason, the tank and the mass flow controller can be brought close to each other, or directly attached to each other, which can produce effects of compactification and thermally substantial unification, resulting in preventing the gas from being liquefied.

In other words, the tank, the first valve unit, and the mass flow controller are mutually connected by the internal flow path formed inside the outer wall of the tank to make piping exposed to the outer air shorter, and therefore a problem that the vaporized gas is liquefied by the piping cooled by a change in ambient temperature, or the like can be prevented from occurring.

Note that closely attaching the mass flow controller onto the outer wall surface of the tank is a concept including directly attaching the mass flow controller onto the outer wall surface through a joint or the like. As a distance to which the mass flow controller and the outer wall surface are brought close to each other, for example, a distance that achieves heat transfer efficiency by which the mass flow controller and tank are brought to substantially the same temperature within a predetermined time is cited.

Also, the first valve unit and the mass flow controller can be directly attached onto the outer wall surface of the tank, so that the tank, the first valve unit, and the mass flow controller are thermally substantially unified, and therefore only by heating any one point, all of the members can be kept at a substantially uniform temperature. Accordingly, only by requisite minimum heating means, the vaporized gas can be prevented by being liquefied again. In addition, inside the outer wall of the tank, the internal flow path provided with the generated gas lead-out line is formed, so that even a flow path that is supposed to be not temperature-controlled can be temperature-controlled through the tank or the like, and therefore the vaporized gas can be further prevented from being liquefied again.

Further, onto the outer wall surface of the tank, the first valve unit and the mass flow controller can be directly attached, so that an additional installation area arising due to the separation between the respective members by an amount corresponding to conventionally present pipes can be eliminated, and therefore the gas supply device can be made very compact.

To eliminate pipes for introducing the material liquid to the inside of the tank as much as possible to configure the gas supply device to be more compact, the gas supply device is only required to be further provided with a second valve unit that is directly attached onto the outer wall surface of the tank, wherein: the internal flow path is further provided with a material liquid introduction line for introducing the material liquid to the inside of the tank; the second valve unit is configured to have a second valve body that is formed with a second inlet port and a second outlet port, and a second valve that is provided inside the second valve body and connected to the second inlet port and the second outlet port; and the material liquid introduction line is provided with a second valve flow-out flow path that makes a connection between the second outlet port and the inside of the tank.

As a more preferred embodiment to advance compactification, one in which the second valve unit is formed with the second inlet port and the second outlet port on one surface of the second valve body, and the material liquid introduction line is further provided with a second valve flow-in flow path that makes a connection between a material liquid introduction port formed on the outer wall surface of the tank and the second inlet port is cited.

To eliminate a pipe for introducing purge gas for purging residual gas at the time of replacing the mass flow controller or, on another occasion, to make the gas supply device compact, the gas supply device is only required to be further provided with a third valve unit attached onto the outer wall surface of the tank, wherein: the internal flow path is further provided with a purge gas introduction line for introducing the purge gas; the third valve unit is configured to have a third valve body formed with a third inlet port and a third outlet port, and a third valve that is provided inside the third valve body and connected to the third inlet port and the third outlet port; and the purge gas introduction line is provided with a third valve flow-out flow path that makes a connection between the third outlet port and the generated gas lead-out line.

As a more preferred embodiment to achieve a compact configuration, one in which the third valve unit is formed with the third inlet port and the third outlet port on one surface of the third valve body, and the purge gas introduction line is further provided with a third valve flow-in flow path that makes a connection between a purge gas introduction port formed on the outer wall surface of the tank and the third inlet port.

To enable gases respectively having different flow rates to be supplied to a plurality of processes, one provided with a plurality of generated gas lead-out lines is cited, wherein each of the generated gas lead-out lines is connected with a mass flow controller.

In order to make it easy to manage layout in a factory or the like, or make a footprint smaller, the gas supply device is only required to have the tank or the mass flow controller attached onto a gas panel.

To enable a pipe between a mass flow controller and a tank to be eliminated in a gas supply device, and the gas supply device to be made compact and have improved heat transfer, the tank is only required to retain material liquid and heat the material liquid in the gas supply device, and be provided with a first valve unit that is configured to have a first valve body that is directly attached onto an outer wall surface of the tank and formed with a first inlet port and a first outlet port on one surface, and a first valve that is provided in a flow path that makes a connection between the first inlet port and the first outlet port, wherein inside an outer wall of the tank, an internal flow path is formed, and the internal flow path is provided with a generated gas lead-out line that is provided with a first valve flow-in flow path that makes a connection between an inside of the tank and the first inlet port, and a first valve flow-out flow path for making a connection between the first outlet port and an introduction port of the mass flow controller.

Advantageous Effects of Invention

As described, according to the gas supply device of the present invention, inside the outer wall of the tank, the internal flow path is formed, and also the first valve unit is attached onto the outer wall surface in a location where the internal flow path is opened on the outer wall surface, so that it is not necessary to provide, between the tank and the mass flow controller, a pipe for providing the first valve unit, and therefore the mass flow controller can be closely or directly attached onto the outer wall surface of the tank. For this reason, a pipe that makes a connection between the respective members can be prevented from being exposed to outer air, and thereby the vaporized air can be prevented from being liquefied due to a temperature change. Further, onto the outer wall surface of the tank, the respective members can be directly or closely attached, so that a whole of the gas supply device can be configured to be a compact and thermally substantially unified one, and therefore, for example, even by temperature-controlling the tank, the whole of the gas supply device can be kept at a uniform temperature to prevent the gas from being liquefied.

DESCRIPTION OF THE EMBODIMENTS

Figure 1:
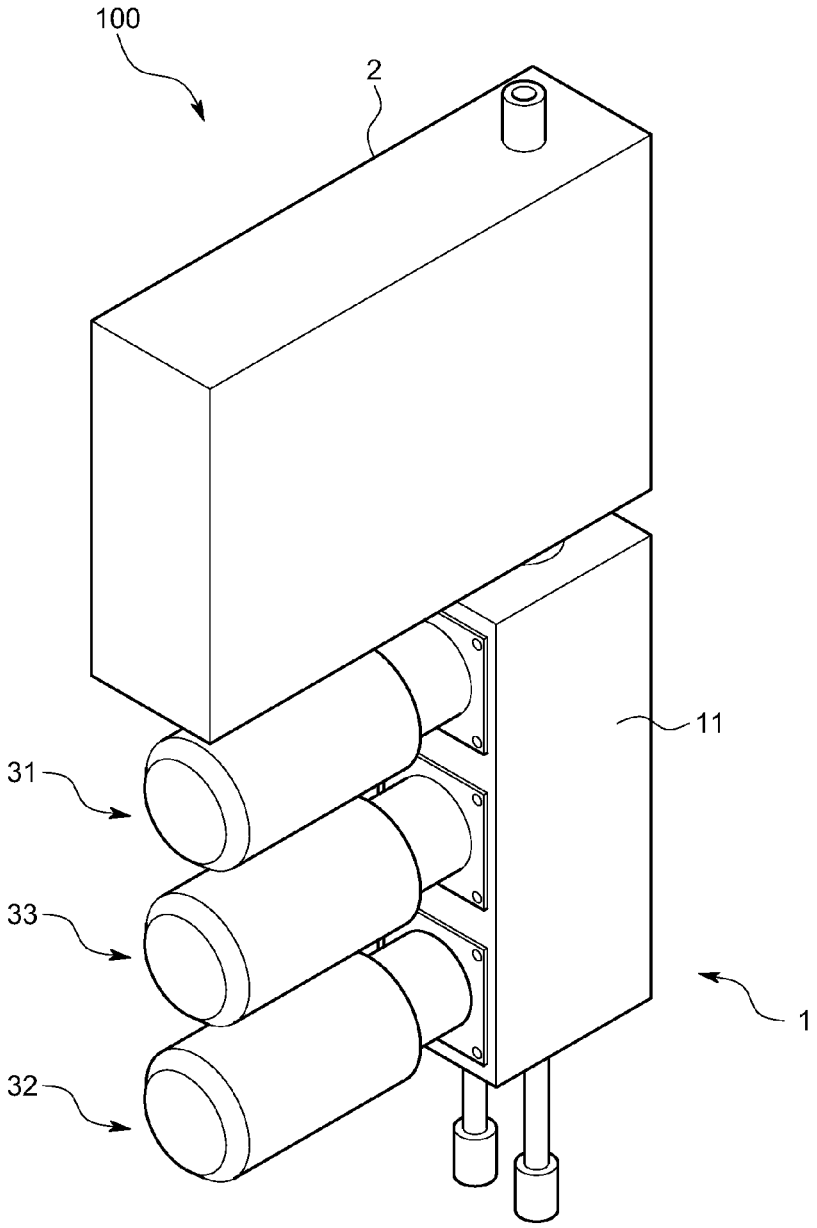
FIG. 1 is a schematic perspective view of a gas supply device according to one embodiment of the present invention.
Figure 2:
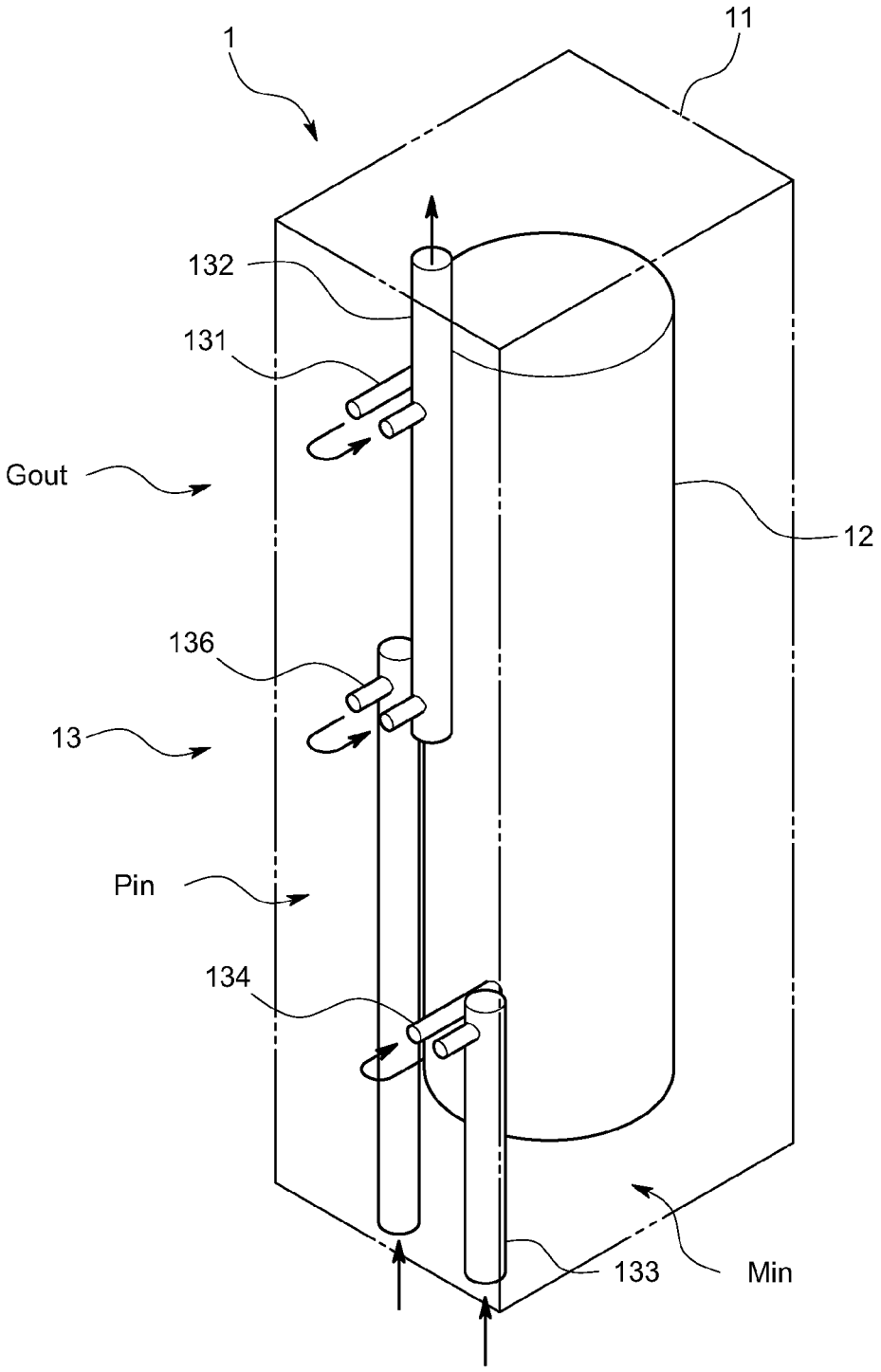
FIG. 2 is a schematic perspective view illustrating an internal flow path of a tank of the gas supply device in the same embodiment.

In the following, one embodiment of the present invention is described referring to the drawings. FIG. 1 illustrates a perspective view illustrating an appearance of a gas supply device 100 of the present embodiment, and FIG. 2 illustrates a schematic diagram illustrating an internal configuration of a tank 1.

Figure 3:
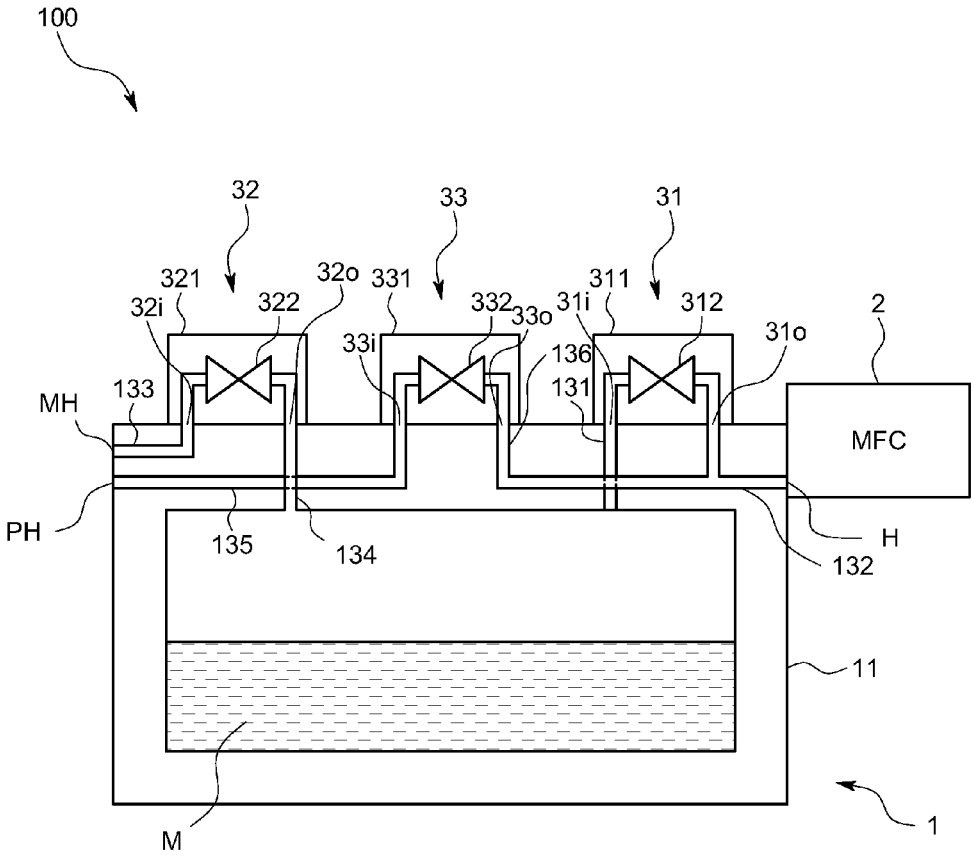
FIG. 3 is a schematic configuration diagram of each piece of equipment of the gas supply device in the same embodiment.

The gas supply device 100 in the present embodiment is one that is intended to supply gas having a predetermined flow rate to a process chamber in a semiconductor manufacturing line or the like, and as illustrated in FIGS. 1 and 3, provided with: a tank 1 configured to retain material liquid M; and three valve units and a mass flow controller 2 that are attached to outer wall surfaces 11 of the tank 1. The gas supply device 100 is one in which an inside of the tank 1 and the mass flow controller 2 are connected to each other through one of the valve units 31, 32, and 33, and adapted to heat the tank 1 with a heater to vaporize the material liquid M, and control a flow rate of resultant vaporized gas with the mass flow controller 2.

To describe a shape of the gas supply device 100 referring to FIG. 1, the tank 1 is of a substantially rectangular parallelepiped shape; on the side surface thereof, the valve units each having a cylindrical appearance are provided in line along a longer direction of the tank 1; onto the upper surface of the tank 1 in FIG. 1, a bottom part of the mass flow controller 2 having a substantially rectangular parallelepiped shape is directly attached; and the mass flow controller 2 is protruded in the same direction as a direction in which the valve units 31, 32, and 33 extend. Also, the tank 1, valve units 31, 32, and 33, and mass flow controller 2 are configured to have substantially the same width in a shorter direction, and as illustrated in FIG. 1, adapted to be thinner in the shorter direction.

Each of the components will now be described.

The mass flow controller 2 is one that operates an opening degree of an internal piezo valve or a solenoid valve so as to make a measured flow rate, which is internally measured, equal to a setting flow rate, which is preliminarily set.

Each of the valve units 31, 32, and 33 is, as illustrated in FIGS. 1 and 3, configured to have a rectangular parallelepiped having a square-shaped surface at the bottom thereof, and a cylindrically shaped valve body 311, 321, or 331 at the top thereof, inside which a valve 312, 322, or 332 that performs open/close operation with, for example, a pivot valve or the like, is provided. Note that in this specification, an actual operating portion is defined as a valve. One surface of a bottom surface of each of the valve bodies 311, 321, and 331 directly attached onto the outer wall surface 11 of the tank 1 is formed with: an inlet port 31*i*, 32*i*, or 33*i* through which fluid flows in; and an outlet port 31*o*, 32*o*, or 33*o* through which the fluid flows out, and each of the valves 312, 322, and 332 is configured such that, inside the valve body 311, 321, or 331, a flow path is formed so as to be connected to the inlet port 31*i*, 32*i*, or 33*i* and the outlet port. In the present embodiment, in an after-mentioned part where a part of the tank 1 has a flat surface, the respective valve units 31, 32, and 33 are collectively attached.

The tank 1 is a block body having the substantially rectangular parallelepiped shape, inside which a cylindrically shaped space is formed, and in the space, the material liquid M is retained. Inside an outer wall of the tank 1, as illustrated in FIG. 2, an internal flow path 13 is formed by boring a hole in the block body with a drill or the like. The internal flow path 13 is provided with: a generated gas lead-out line Gout for leading out the gas vaporized in the internal space 12 of the tank 1 to the mass flow controller 2; a material liquid introduction line Min for introducing the material liquid M into the internal space 12 of the tank 1; and a purge gas introduction line Pin for introducing purge gas that purges residual gas at the time of replacing the mass flow controller 2, or on another occasion.

Each of the lines of the internal flow path 13 will now be described. In the following description, the three valve units illustrated in the perspective view of FIG. 1 are described with in relation to descriptions in claims, i.e., sequentially from above in the perspective view, a first valve unit 31, a third valve unit 33, and a second valve unit 32. Note that the first, second, and third valve units 31, 32, and 33 are respectively associated with the generated gas lead-out line Gout, material liquid introduction line Min, and purge gas introduction line Pin. In addition, the first and third valve units 31 and 33 are configured such that the gases mainly flow therethrough, respectively, and the second valve unit 32 is configured such that the liquid mainly flows therethrough.

The generated gas lead-out line Gout is, as illustrated in FIGS. 2 and 3, provided with: a first valve flow-in flow path 131 that makes a connection between the inside of the tank 1 and the first inlet port 31*i* of the first valve unit 31; and a first valve flow-out flow path 132 that makes a connection between the first outlet port 310 of the first valve unit 31 and an introduction port H of the mass flow controller 2.

The first valve flow-in flow path 131 is, in FIG. 2, formed by boring a hole from the side surface of the tank 1 where the respective valve units are attached to the internal space 12 of the tank 1, and the first valve flow-out flow path 132 is formed by boring a hole from the upper surface of the tank 1 in the longer direction, and in such a way as to intersect with the hole, boring a hole vertically from an upper part of the side surface.

The material liquid introduction line Min is, as illustrated in FIGS. 2 and 3, provided with: a second valve flow-in flow path 133 that makes a connection between a material liquid introduction port MH formed on a bottom surface that is a surface facing to the surface attached with the mass flow controller 2 and the second inlet port 32*i* of the second valve unit 32; and a second valve flow-out flow path 134 that makes a connection between the second outlet port 32*o* of the second valve unit 32 and the internal space 12 of the tank 1.

The second valve flow-in flow path 133 is, as illustrated in FIG. 2, formed by boring a hole from the bottom surface of the tank 1 in the longer direction, and in such a way as to intersect with the hole, boring a hole vertically from a lower part of the side surface. The second valve flow-out flow path 134 is formed by boring a hole vertically from the side surface to open into the internal space 12.

The purge gas introduction line Pin is, as illustrated in FIGS. 2 and 3, provided with: a third valve flow-in flow path 135 that makes a connection between a purge gas introduction port PH formed on the bottom surface and the third inlet port 33*i* of the third valve unit 33; and a third valve flow-out flow path 136 that makes a connection between the third outlet port 33*o* of the third valve unit 33 and the first valve flow-out flow path 132 constituting the generated gas lead-out line Gout.

The third valve flow-in flow path 135 is, as illustrated in FIG. 2, formed by boring, in the longer direction, a hole from the purge gas introduction port formed on the bottom surface, and in such a way as to intersect with the hole, boring a hole vertically from a central part of the side surface. The third valve flow-out flow path 136 is formed by boring a hole from the side surface in such a way as to intersect with the first valve flow-out flow path 132.

As described above, it is configured such that inside the outer wall of the tank 1, the internal flow path 13 is formed, and onto the outer wall surfaces 11 of the tank 1, the respective valve units and the mass flow controller 2 can be directly attached.

Thus, according to the gas supply device 100 of the present embodiment, the internal flow path 13 is formed inside the outer wall, and also the respective valve units are directly attached onto the outer wall surfaces 11 with respect to the tank 1, so that it is not necessary to provide piping such as a pipe between the tank 1 and the mass flow controller 2. Accordingly, the tank 1 and the mass flow controller 2 can be directly attached to each other, and therefore a whole of the gas supply device 100 can be configured to be a compact and also thermally unified one. For this reason, by heating the tank 1 with the heater, heat is sufficiently transferred even to the respective valve units and mass flow controller 2 to be able to keep a sufficiently uniform temperature in all of the components. Accordingly, the once vaporized gas can be preferably prevented from being liquefied again to return to the material liquid M, and therefore operating efficiency of the gas supply device 100 can be considerably improved.

Also, piping that is supposed to be exposed to surrounding outer air and act as one cause to liquefy gas can be configured to be completely or almost prevented from being exposed to the surrounding outer air, which makes it possible to more easily prevent the gas from being liquefied.

Other embodiments will now be described.

In the above-described embodiment, the internal flow path is provided with the purge gas introduction line; however, for example, when there is nearly no necessity for the replacement, etc., of the mass flow controller, the internal flow path may not include the purge gas introduction line.

Each of the second valve unit and third valve unit is, on the bottom surface of the valve body, formed with the inlet port and outlet port; however, at least only the outlet port may be provided so as to be able to be in contact with the outer wall surface of the tank 1. In such a case, the inlet port may be adapted to be connected to the pipe through which the material liquid or purge gas flows.

In the above-described embodiment, the tank is one having the rectangular parallelepiped shape; however, the tank may have a shape having a curved surface, such as a cylindrical shape. Also, in the case where the tank has a shape having a curved surface, in order to make it easier to attach each of the valve units or the mass flow controller, the outer wall surface of the tank is preferably partially formed with a flat surface.

A method for attaching the mass flow controller to the tank may be one that directly attaches a housing of the mass flow controller onto the outer wall surface of the tank. In this case, heat transfer between the tank and the mass flow controller is significantly enhanced, resulting in a preferred embodiment for, in particular, prevention of the gas from being liquefied.

Also, a joint may be present between the mass flow controller and the tank, and they may be closely attached to each other. In short, it is only necessary to eliminate the presence of a pipe having a length enabling the gas to be liquefied between the tank and the mass flow controller. In addition, on a connection surface between the tank and the mass flow controller, an O-shaped groove may be formed, and they may be connected to each other so as to be able to be sealed with an O-ring.

Further, the tank and the mass flow controller may be integrally shaped. In this case, it becomes easier to control temperatures of the respective members; however, it becomes difficult to perform calibration of the mass flow controller, or the like. To prevent such a problem, the mass flow controller and the tank are preferably configured to be detachable.

In the above-described embodiment, the material liquid introduction port and the purge gas introduction port are provided on the bottom surface of the tank, which is a surface facing to the mass flow controller; however, they may be provided in another location. In light of easy formation of the internal flow path, and preventing locations of other members from being blocked, it is preferable to form the material liquid introduction port or the purge gas introduction port on a surface other than the surface provided with the valve units or the mass flow controller.

Figure 4:
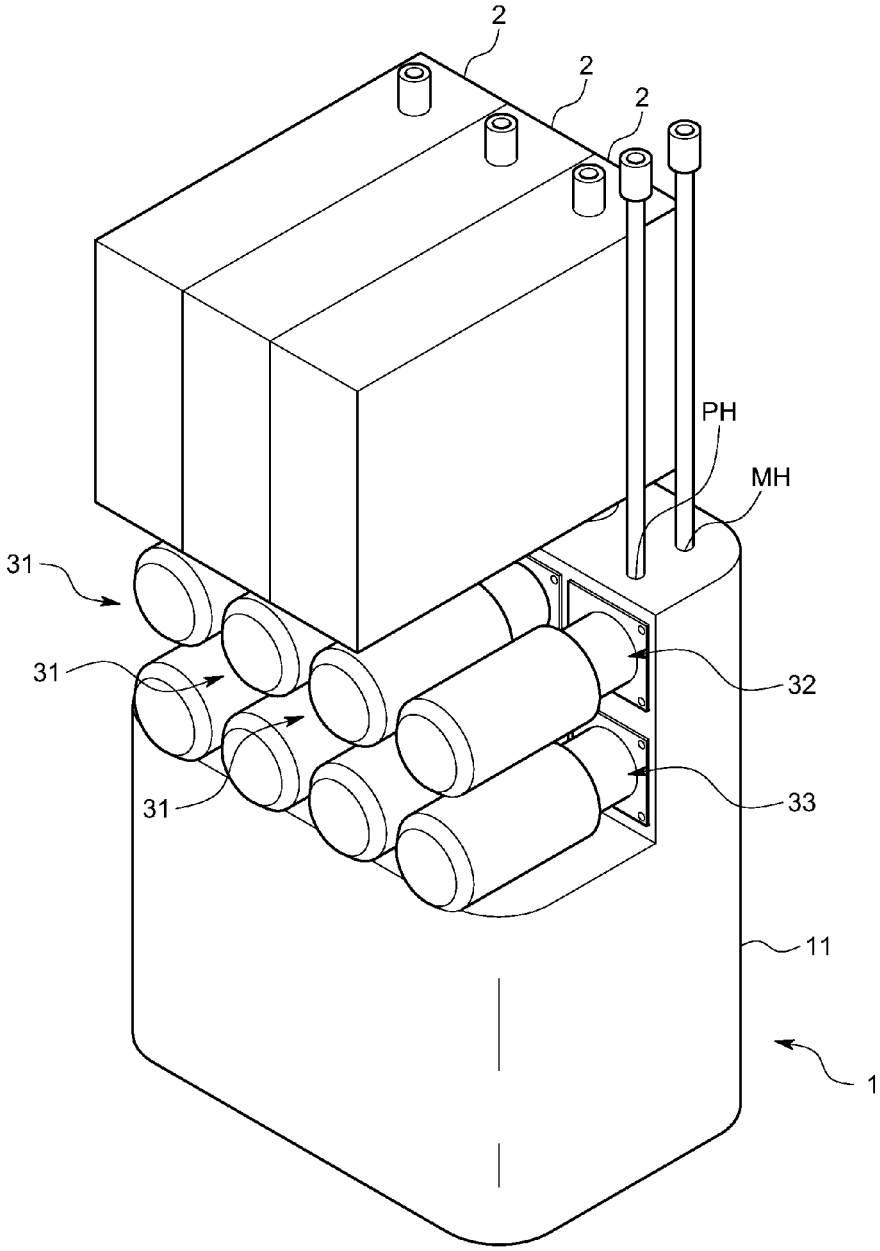
FIG. 4 is a schematic perspective view of a gas supply device according to another embodiment.

The above-described embodiment is adapted to supply the gas through only the one line; however, gases having different flow rates may be able to be supplied through a plurality of lines. Specifically, as illustrated in FIG. 4, it is only necessary to provide a plurality of generated gas lead-out lines Gout, and connect the mass flow controllers 2 to the respective generated gas lead-out lines Gout.

Also, the respective generated gas lead-out lines Gout may be respectively connected to different internal spaces inside the tank, or all of the generated gas lead-out lines Gout may be connected to and share a common internal space inside the tank.

Figure 5:
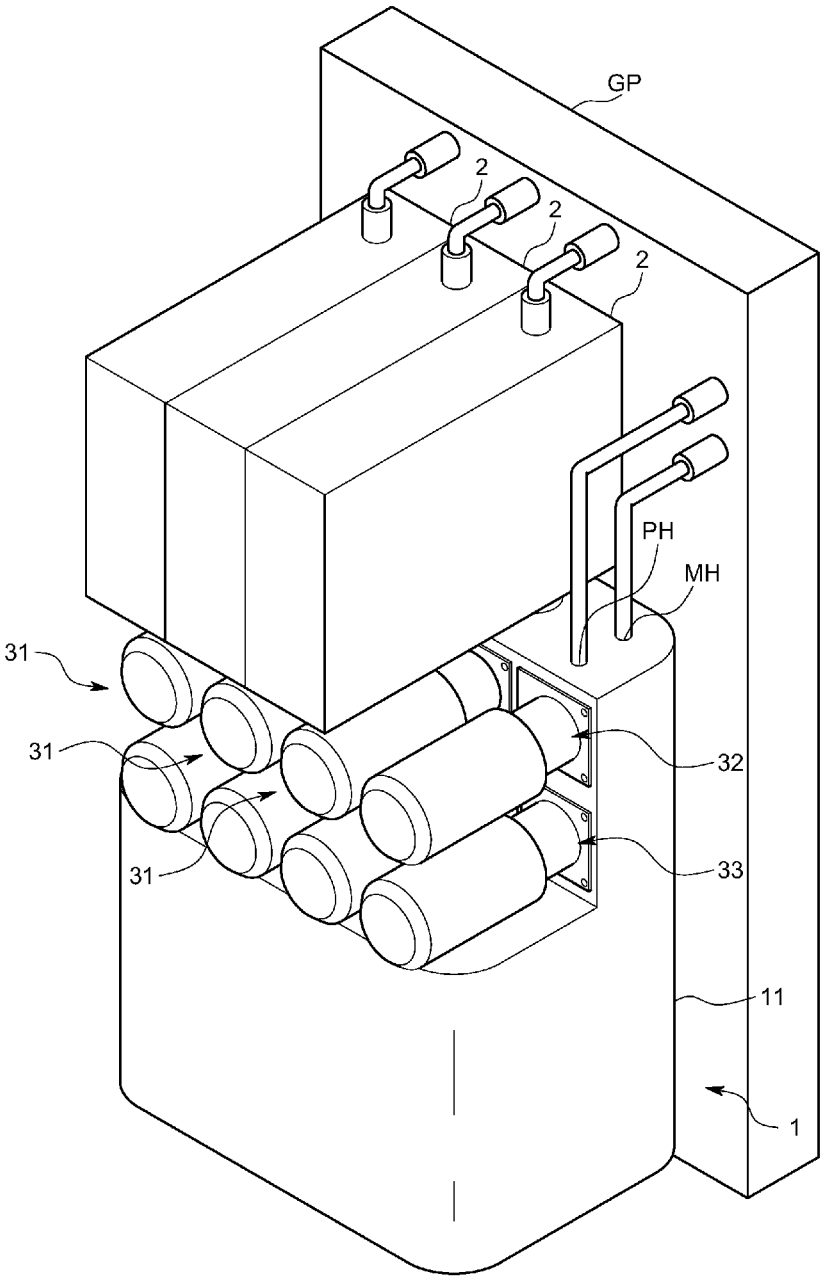
FIG. 5 is a schematic perspective view of a gas supply device according to still another embodiment.
Figure 6:
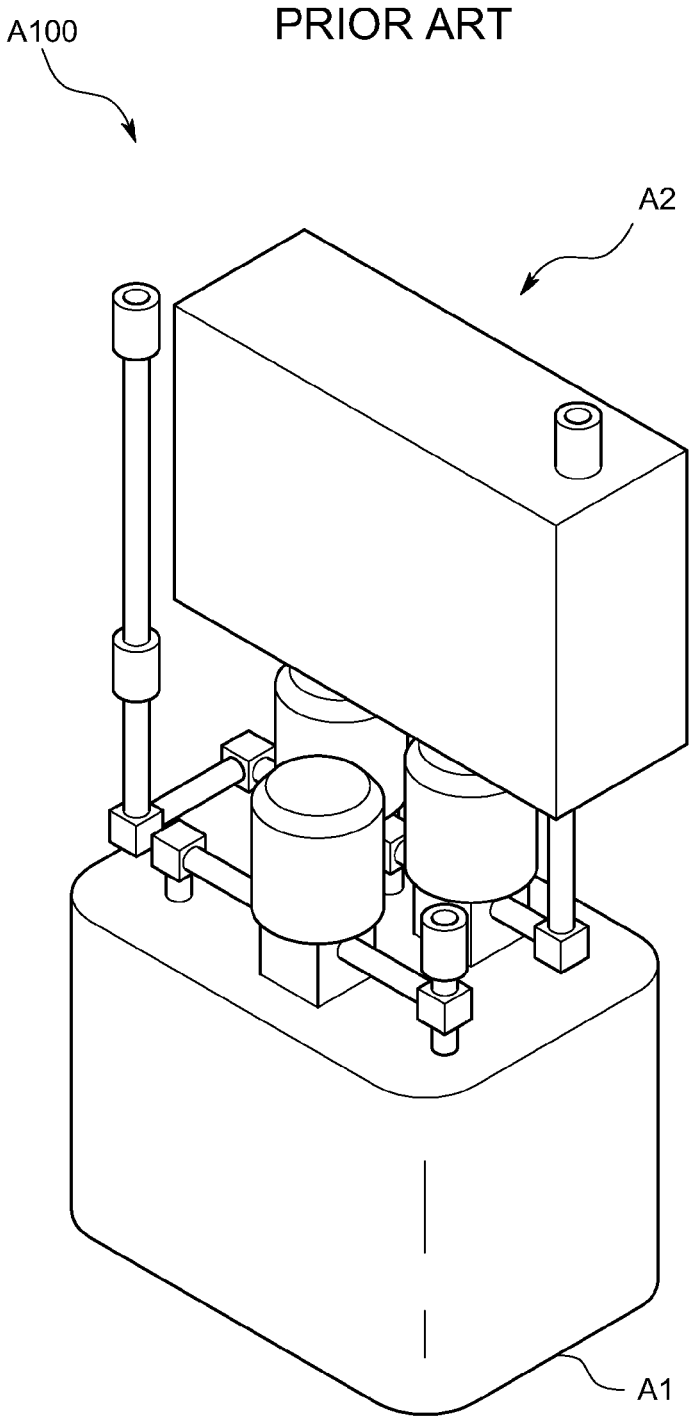
FIG. 6 is a schematic perspective view of a conventional gas supply device.
Figure 7:
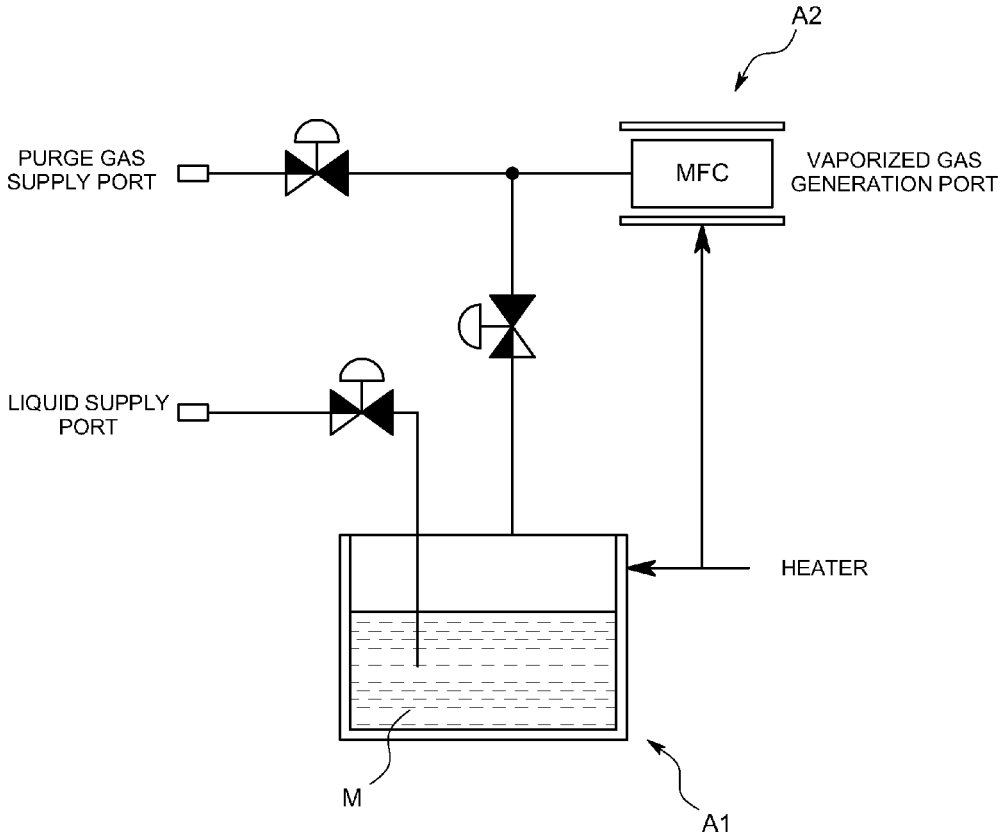
FIG. 7 is a schematic perspective view of the conventional gas supply device.

Further, as illustrated in FIG. 5, the tank 1 and mass flow controllers 2 of the gas supply device 100 may be attached onto a gas panel GP. Note that the gas panel GP refers to a panel mounted with pieces of gas equipment such as a meter, a mass flow controller, and a valve. The gas supply device 100 may be configured such that the pieces of gas equipment are first attached onto the gas panel GP, and then the respective pieces of gas equipment are connected to each other through pipes, or a gas flow-in port and a gas flow-out port of each piece of gas equipment are directly connected to the panel, and through flow paths formed inside the panel, gases flow through the respective pieces of gas equipment. Also, the gas supply device 100 may be configured such that, by connecting respective panels, the respective pieces of gas equipment can be connected. In this embodiment, a back surface of the gas supply device 100 in the diagram is formed with a flat surface, so that the gas supply device 100 can be directly attached onto a flat surface of the gas panel, and also a piece of gas equipment other than the gas supply device 100 can be easily connected to the gas panel. Also, the gas panel can minimize piping that connects the respective pieces of gas equipment, and make it easier to have visual contact with a layout to arrange the respective pieces of gas equipment within a minimum area, so that the gas panel can make the gas supply device 100 easier to use as fluid control equipment, and decrease a footprint (installation area) in a use location such as a factory. Also, only the tank 1 may be configured to be attached onto the gas panel GP, or only the mass flow controllers 2 may be configured to be attached onto the gas panel.

Furthermore, various modifications and combinations are possible so long as they are not contrary to the principles of the present invention.

INDUSTRIAL APPLICABILITY

According to the present invention, a gas supply device that can prevent pipes connecting respective members from being exposed to outside air and also vaporized gas from being liquefied by a temperature change can be obtained.

REFERENCE CHARACTERS LIST

100: Gas supply device
1: Tank
11: Outer wall surface
13: Internal flow path
2: Mass flow controller
31: First valve unit
32: Second valve unit
33: Third valve unit
Gout: Generated gas lead-out line
Min: Material liquid introduction line
Pin: Purge gas introduction line
GP: Gas panel

The invention claimed is:

1. A gas supply device comprising:

a tank configured to retain material liquid and heat the material liquid; and a mass flow controller configured to be connected to an inside of the tank through a first valve unit and control a flow rate of gas resulting from vaporizing the material liquid, wherein:

the first valve unit is configured to have a first valve body that is directly attached onto an outer wall surface of the tank and formed with a first inlet port and a first outlet port on a surface of the valve unit that is mounted to the outer wall surface of the tank, and a first valve that is provided in an in-valve flow path within the first valve unit that makes a connection between the first inlet port and the first outlet port of the first valve unit; and inside an outer wall of the tank, an internal flow path is formed which includes a first valve flow-in flow path and a first valve flow-out path, the first valve flow-in path connecting the inside of the tank and the first inlet port of the first valve unit, and the first valve flow-out flow path connecting the first outlet port of the first valve unit and an introduction port of the mass flow controller, wherein a portion of the first valve flow-out flow path extends in a direction that runs substantially parallel to the outer wall surface to which the first valve unit is attached, the internal flow path and the in-valve flow path being configured to flow generated gas from the tank through the first valve flow-in path of the internal flow path in the outer wall in a gas travel path, through the in-valve flow path in the first valve unit, and through the first valve flow-out path of the internal flow path in the outer wall, to the introduction port of the mass flow controller, such that the gas in a gas travel path does not travel outside the outer wall except when in the first valve unit.

2. The gas supply device according to claim 1, further comprising a second valve unit that is directly attached onto the outer wall surface of the tank, wherein:

the internal flow path is further provided with a material liquid introduction line for introducing the material liquid to the inside of the tank;

the second valve unit is configured to have a second valve body that is formed with a second inlet port and a second outlet port, and a second valve that is provided inside the second valve body and connected to the second inlet port and the second outlet port; and the material liquid introduction line comprises a second valve flow-out flow path that makes a connection between the second outlet port and the inside of the tank.

3. The gas supply device according to claim 1, provided with a plurality of generated gas lead-out lines, wherein each of the generated gas lead-out lines is connected with a mass flow controller.

4. The gas supply device according to claim 1, wherein the tank or the mass flow controller is attached onto a gas panel.

5. A tank for a gas supply device, the tank configured to retain material liquid and heat the material liquid in the gas supply device, and comprising a first valve unit that is configured to have a first valve body that is directly attached onto an outer wall surface of the tank and formed with a first inlet port and a first outlet port on a surface of the valve unit that is mounted to the outer wall surface of the tank, and a first valve that is provided in an in-valve flow path within the first valve unit that makes a connection between the first inlet port and the first outlet port of the first valve unit, wherein inside an outer wall of the tank, an internal flow path is formed which includes a first valve flow-in flow path and a first valve flow-out path, the first valve flow-in path connecting an inside of the tank and the first inlet port of the first valve unit, and the first valve flow-out flow path connecting the first outlet port of the first valve unit and an introduction port of a mass flow controller, wherein a portion of the first valve flow-out flow path extends in a direction that runs substantially parallel to the outer wall surface to which the first valve unit is attached, the internal flow path and the in-valve flow path being configured to flow generated gas from the tank through the first valve flow-in path of the internal flow path in the outer wall in a gas travel path, through the in-valve flow path in the first valve unit, and through the first valve flow-out path of the internal flow path in the outer wall, to the introduction port of the mass flow controller, such that the gas in a gas travel path does not travel outside the outer wall except when in the first valve unit.

* * * * *

UNITED STATES PATENT AND TRADEMARK OFFICE

CERTIFICATE OF CORRECTION

PATENT NO. : 9,157,578 B2
APPLICATION NO. : 13/254826
DATED : October 13, 2015
INVENTOR(S) : Hayashi It is certified that error appears in the above-identified patent and that said Letters Patent is hereby corrected as shown below:

In the claims, column 9, line 28, claim 1, delete “a” and insert --the-- and;

column 10, line 34, claim 5, delete “a” and insert --the--.

Signed and Sealed this
Fifteenth Day of March, 2016

Michelle K. Lee

Michelle K. Lee
*Director of the United States Patent and Trademark Office*